US005251862A

United States Patent [19]

Raymond

[11] Patent Number: 5,251,862

[45] Date of Patent: Oct. 12, 1993

[54] TRANSPORTING AND LIFTING APPARATUS AND METHODS FOR AIDING HANDICAPPED INDIVIDUALS

[76] Inventor: Walter Raymond, 1440 Davenport St., Sturgis, S. Dak. 57785

[21] Appl. No.: 803,447

[22] Filed: Dec. 6, 1991

[51] Int. Cl.[5] ..... A45D 19/04

[52] U.S. Cl. ..... 248/396; 5/81.1; 5/86.1; 297/DIG. 10

[58] Field of Search ..... 248/396, 371, 398, 423; 297/5, DIG. 10, 325, 345; 5/81.1, 83.1, 86.1; 4/479, 480, 483

[56] References Cited

U.S. PATENT DOCUMENTS

| | | | |
|---|---|---|---|
| 2,459,066 | 1/1949 | Duke | 297/5 |
| 2,539,577 | 1/1951 | Hack | 297/5 |
| 2,913,732 | 11/1959 | Jones | 4/480 |
| 3,224,016 | 12/1965 | Anderson et al. | 5/327 |
| 3,386,111 | 6/1968 | Daniel | 5/81.1 |
| 3,788,695 | 1/1974 | Salem | 297/5 X |
| 3,829,908 | 8/1974 | Thomas | 4/483 |
| 3,854,773 | 12/1974 | Thomas | 4/480 X |
| 4,165,127 | 8/1979 | Vago | 297/345 |
| 4,249,774 | 2/1981 | Andreasson | 297/311 |
| 4,941,708 | 7/1990 | Heffner | 297/6 |
| 4,979,726 | 12/1990 | Geraci | 297/313 |
| 5,123,126 | 6/1992 | Vincent | 4/483 X |
| 5,163,188 | 11/1992 | Munroe | 4/483 X |

*Primary Examiner*—David M. Purol
*Attorney, Agent, or Firm*—Nixon & Vanderhye

[57] ABSTRACT

The apparatus includes a frame having a pair of sleeves adjacent opposite sides thereof for receiving the legs of inverted, generally U-shaped bars. Lifting tubes are provided along opposite sides of the frame for receiving a lifting lever. By applying the lifting lever alternately to opposite sides of the frame, the frame can be lifted into an elevated position, with cooperating ratchets and ratchet teeth along the frame and legs cooperating to prevent slippage of the frame in a downward direction. Casters may be provided the frame for moving the frame in a horizontal direction.

15 Claims, 5 Drawing Sheets

FIG. 6
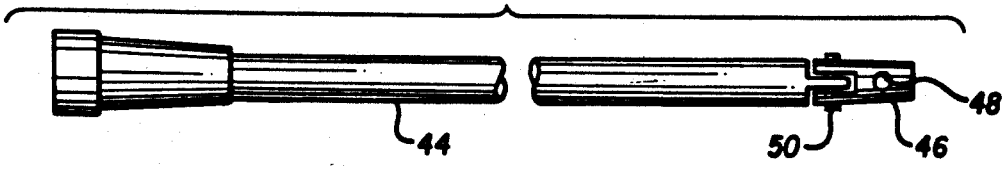
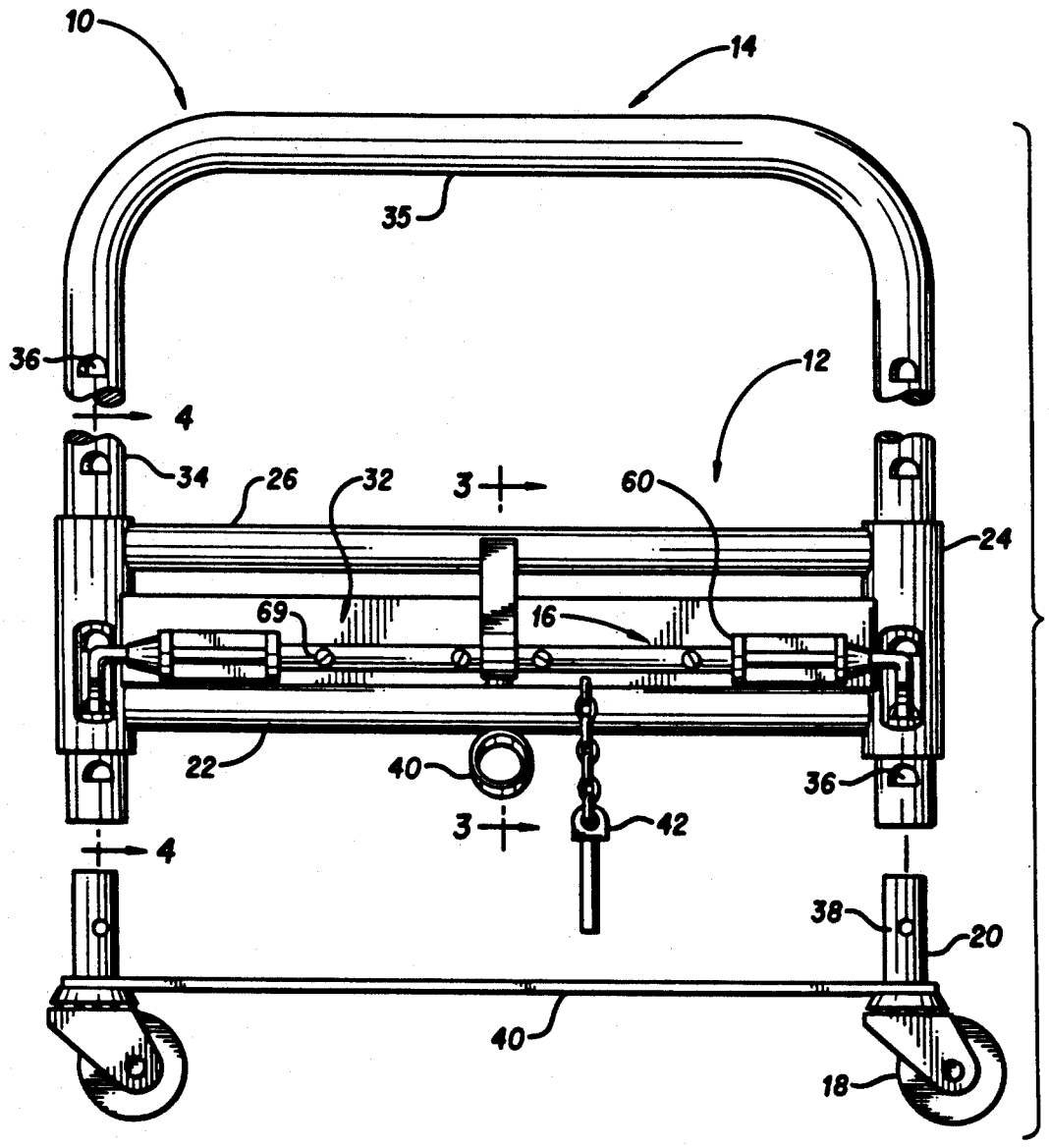
FIG. 1

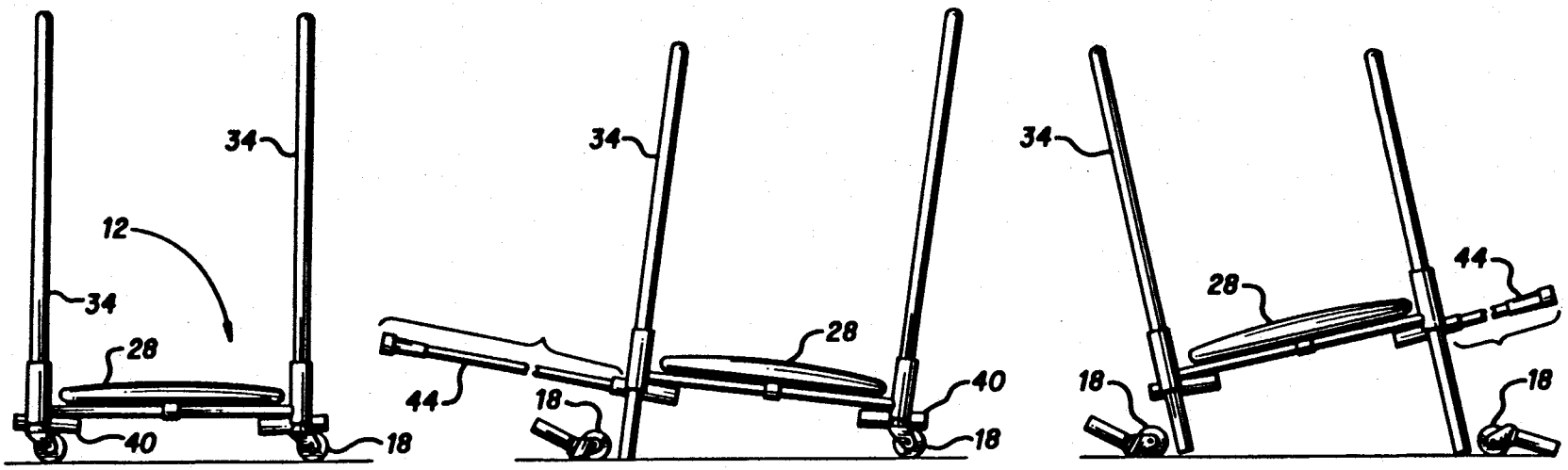
FIG. 7A
FIG. 7B
FIG. 7C
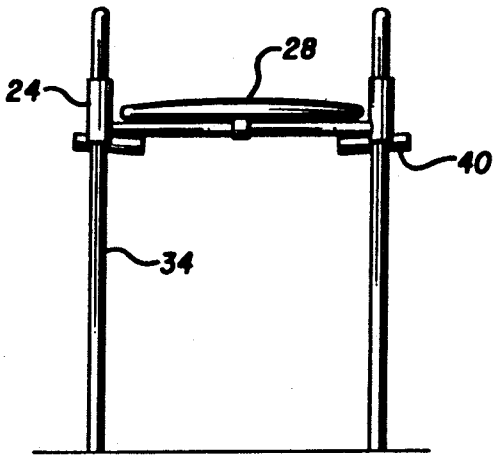
FIG. 7E
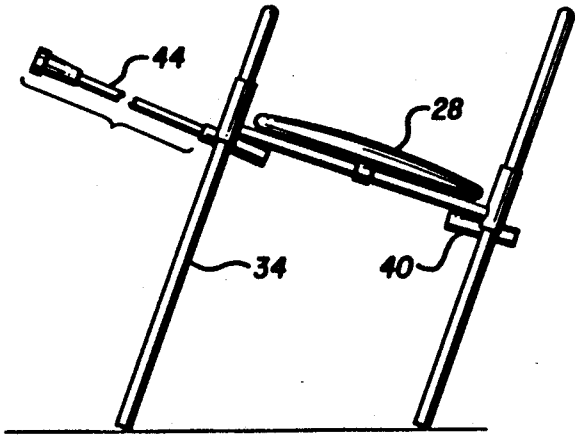
FIG. 7D

TRANSPORTING AND LIFTING APPARATUS AND METHODS FOR AIDING HANDICAPPED INDIVIDUALS

BACKGROUND AND SUMMARY OF THE INVENTION

The present invention relates to a transporting and lifting apparatus, useful for aiding handicapped individuals, and particularly relates to a transporting and lifting apparatus for transporting and lifting or elevating an individual who might otherwise not be able to lift themselves, for example, from a fallen position on the floor.

Not infrequently, handicapped individuals and others find themselves in a position where they cannot lift themselves into an elevated position because of the handicap or other incapacitating conditions For example, a handicapped individual may slip from a bed or wheelchair onto the floor or when moving from one place to another. That individual may not have the capacity to lift himself or herself into an elevated position, for example, into a sitting position on a chair. Additionally, his or her weight may be sufficient such that another individual may not be able to provide the necessary assistance to lift the incapacitated individual into the elevated position. Further, the incapacitated individual may require movement from a particular position before being lifted into a seated or wheelchair-height position. Thus, if the individual falls in a remote area where assistance to that individual is difficult, such as in a corner of the room, the incapacitated individual may first have to be moved or transported before being helped into the elevated position.

The present invention primarily provides a lifting apparatus by which an individual who cannot raise himself or herself may, with assistance, be elevated into another position, for example, a sitting position, or to wheelchair height. More particularly, the present invention relates to a lifting chair-like platform on which the incapacitated individual may be initially disposed and subsequently lifted, with the assistance of another individual, using a bilateral ratcheting motion, i.e., a rocking motion of the device, wherein the platform may be raised from adjacent floor level to an elevated level, for example, chair height. Additionally, should the incapacitated individual require translational movement, i.e., movement from a location where it is inconvenient to rise, before being lifted into the elevated position, the chair-like platform hereof is provided with casters. Thus, once the incapacitated individual is disposed on the platform at floor level, the platform may be translated horizontally into a position more convenient for lifting the individual into the desired elevated position.

According to the present invention, there is provided a frame which has a generally centrally disposed platform or seat on which the incapacitated individual may be initially placed. The frame also includes a pair of sleeves or tubes adjacent each of the opposite sides of the frame. The lifting apparatus also includes a pair of inverted, generally U-shaped, bars, each having a pair of legs joined at their upper ends by a crossover bar. The legs of each U-shaped bar are telescopically receivable in corresponding sleeves of the frame along the respective opposite sides. Each of the legs includes a plurality of ratchet teeth spaced longitudinally therealong. Along each of the opposite sides of the frame, there is provided a pair of ratchet catches forming part of a unitary assembly for engagement with the ratchet teeth of the legs of the corresponding U-shaped bar. Each ratchet assembly is biased in a direction to engage the ratchet catches with the ratchet teeth of the legs to maintain the frame at a selected elevated position along the U-bars.

With the frame supported on the floor and the distal ends of the legs of each U-shaped bar disposed in the sleeves along opposite sides of the frame, it will be appreciated that the frame is movable in an upward or first direction relative to the U-shaped bars by a ratcheting action. Moreover, the frame may be locked in selected adjusted elevated positions along each of the inverted U-shaped bars by the engagement of the ratchet catches with the corresponding ratchet teeth. Importantly, and for reasons which will become clear, each ratchet assembly is operated independently of the ratchet assembly of the other side of the frame. For actuating this ratcheting action, there is mounted adjacent each side of and on the frame a slightly upwardly inclined lifting tube for receiving the end of a lifting lever.

To use the lifting apparatus hereof, the frame with the attached chair-like platform or seat is disposed adjacent to the incapacitated individual. Usually, the incapacitated individual will be able to position himself or herself on the platform at floor level. Of course, another individual may assist in locating the incapacitated individual on the platform. Once positioned on the platform, an assisting individual locates the legs of the U-bars telescopically within the sleeves of the frame and inserts one end of the lifting lever into the lifting tube on one side of the frame.

When the assisting individual lifts the lever, the entire lifting apparatus may be pivoted about the bottom of the frame about an axis along the opposite side of the apparatus. As the one side of the frame is lifted upwardly in a first direction, i.e., pivoted about its other side, the inverted U-shaped bar on the lifted side of the frame will slide or telescope within the sleeve , ratcheting past the ratchet catches until the distal ends of the legs of the bar engage the floor. This lifting action is then discontinued, permitting the catches to engage the ratchet teeth, leaving the platform in an inclined or tilted position from side to side. The lever is then removed from the one side and inserted into the lifting tube on the other side of the frame. In similar fashion, the other side of the lifting apparatus is lifted by the assisting individual by pivoting the apparatus about an axis passing through the distal ends of the U-bar adjacent the one side of the apparatus. This permits the U-bar on the other side of the frame to similarly ratchet through the sleeves until the other side of the platform is at an elevated position higher than the position of the one frame side. It will be appreciated that when the weight of the apparatus and the individual carried thereby is shifted or rocked from side to side, the ratchet catches will engage in the ratchet teeth and prevent the frame from sliding downwardly along the U-bars in a second direction.

From the foregoing description, it will be appreciated that by alternating the lifting effort from one side to the other side, i.e., back and forth, a bilateral incremental ratcheting of the frame in an upward or first direction along the U-bars is achieved. While the individual on the platform is inclined from side-to-side during this process, the inclinations are not sufficiently great to cause the individual to fall from the platform. It will also be appreciated that this side-to-side rocking motion, by which one side is lifted and locked into position and then the other side is lifted and locked into position, eventually raises the platform from floor level to an appropriate height, for example, wheelchair-height, whereby the incapacitated individual may be transferred from the lifting apparatus to the wheelchair, chair or bed.

In those situations where the individual has fallen in an area where it is inconvenient to lift the individual as just described, casters may be provided on the lower ends of the sleeves of the frame. Once the individual is positioned on the platform adjacent floor level, the lever may be connected to the frame to serve as a handle for moving the apparatus horizontally along the floor to a position where it is convenient to operate the lever in conjunction with the lifting apparatus to raise the individual into the elevated position as previously described. In this aspect of the invention, the U-bars are inserted into the upper ends of the sleeves and, upon raising each side of the frame initially, the casters will drop from the frame or be forced from the frame by the U-bars, enabling the distal ends of the U-bars to pass through the sleeves and engage the floor as described above.

Another feature of the present invention resides in the capability of interchanging the platform with other support devices. For example, the platform or seat is preferably removably clipped to the frame and thus easily removed and replaced, for example, by a toilet seat. By clipping a toilet seat with an underlying plastic container to the frame, the lifting apparatus may be transposed into a commode. Another alternative is to provide a seat which facilitates an individual taking a shower. It will also be appreciated that, while the description herein is presented with respect to a lifting apparatus for handicapped individuals, it is not limited thereto in that the apparatus may be used to transport or elevate other loads, as necessary or desirable.

In a preferred embodiment according to the present invention, there is provided apparatus for lifting a load, comprising a frame having a generally centrally disposed member for bearing a load and a plurality of elements spaced one from the other about the periphery of the frame and with first and second pairs of elements lying on opposite sides of the frame and first and second pairs of legs for disposition in slidable relation to the first and second pairs of elements, respectively. Means are carried by the frame on the opposite sides thereof cooperable with the first and second pairs of legs, respectively, when the legs are disposed in slidable relation to the elements, for enabling movement of the frame relative to the legs in a first direction into selected adjusted positions relative to one another and for releasably precluding movement of the frame relative to the legs in a second direction opposite the first direction in each selected adjusted position thereof. The cooperable means on the opposite sides of the frame are independent of one another whereby one side of the frame is movable relative to the pair of legs on one side thereof and in the first direction, while the other side of the frame and the other pair of legs on the other side of the frame remain immovable relative to one another. Means are carried by the frame for alternately moving the opposite sides of the frame in the first direction relative to the pair of legs on the corresponding side of the frame for displacing the load carried by the centrally disposed member in the first direction.

In a further preferred embodiment of the present invention, there is provided a method for lifting a load, comprising the steps of (a) providing a frame having a generally centrally disposed member for bearing a load and a plurality of sleeves spaced one from the other about the periphery of the frame with first and second pairs of the elements lying on opposite sides of the frame, (b) disposing first and second pairs of legs in slidable telescopic relation with the first and second pairs of sleeves, respectively, (c) moving one side of the frame and the first sleeves of the frame upwardly relative to the first pair of legs into a first selected adjusted elevation while precluding movement of the opposite side of the frame and the second sleeves hereof relative to the second pair of legs in a downward direction, (d) subsequently moving the opposite side of the frame and the second sleeves thereof upwardly relative to the second pair of legs into a second selected adjusted elevation above the first elevation while precluding movement of the one side of the frame and the first sleeves thereof relative to the first pair of legs in a downward direction and (e) alternately moving opposite sides of the frame in accordance with steps (c) and (d) hereof for displacing the load carried by the centrally disposed member in an upward direction.

Accordingly, it is a primary object of the present invention to provide a novel and improved lifting device for elevating loads and particularly adapted for use by handicapped individuals for elevating themselves from a position, for example, adjacent floor level, into an elevated position, for example, at a height facilitating a handicapped individual's movement into a chair or onto a bed.

These and further objects and advantages of the present invention will become more apparent upon reference to the following specification, appended claims and drawings.

BRIEF DESCRIPTION OF THE DRAWING FIGURES

FIG. 1 is a fragmentary side elevational view of a lifting apparatus according to the present invention, with parts broken out for ease of illustration;

FIG. 6 is a fragmentary elevational view of a lifting lever and handle for use with the lifting apparatus hereof;

FIGS. 7A-7E are schematic end elevational views illustrating in exaggerated fashion the manner of elevating the platform or seat of the present invention.

DETAILED DESCRIPTION OF THE DRAWING FIGURES

Figure 2:
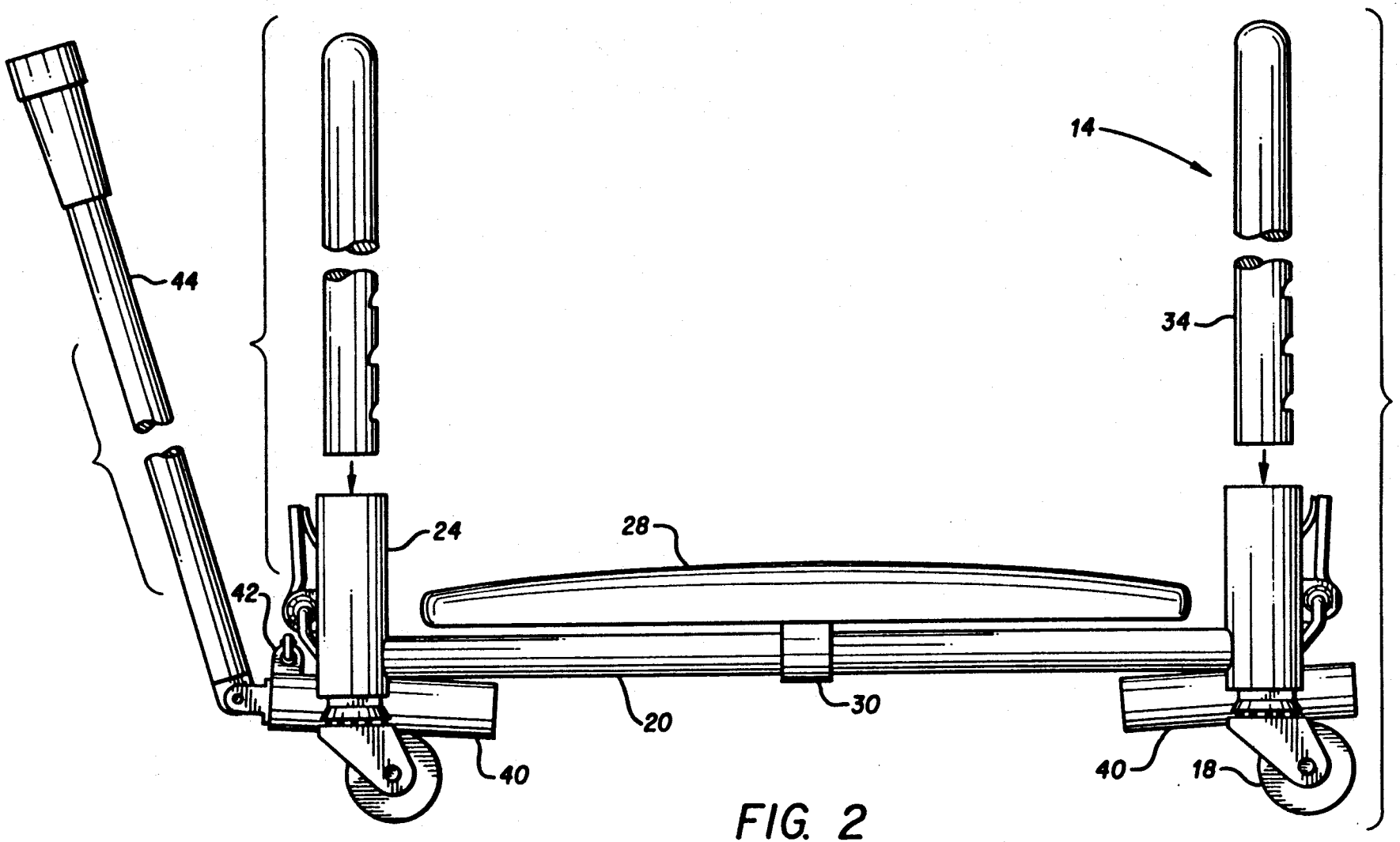
FIG. 2 is an end elevational view of the apparatus illustrated in FIG. 1 looking from left to right.

Reference will now be made in detail to a present preferred embodiment of the invention, an example of which is illustrated in the accompanying drawings.

Referring now to the drawings, particularly to FIG. 1, there is illustrated a lifting apparatus according to the present invention, generally designated 10. Lifting apparatus 10 includes a frame, generally designated 12, a pair of inverted, generally U-shaped bars 14, a ratcheting or catch assembly 16 and detachable casters 18. Particularly, frame 12 includes a pair of longitudinal and transversely extending support tubes or structural elements 20 and 22, respectively, interconnecting one with the other at the corners of the generally rectangular frame 12 by vertically extending sleeves or tubes 24. The sides of the frame, one of which is illustrated in FIG. 1, has upper and lower structural members interconnecting sleeves 24, the upper member being designated 26. Consequently, in the preferred embodiment, frame 12 is generally of a square or rectangular configuration, with the corners constituted by sleeves 24. It will be appreciated that the structural members interconnecting sleeves 24 need not extend along the periphery of the frame but could be inset.

As illustrated in FIG. 2, there is provided a platform or seat 28 suitably, and preferably releasably, secured to the structural members 20 or 22 of the frame, for example, by clips 30. Between the upper and lower structural members 22 and 26 along each of the opposite sides of the frame, there is provided a plate 32 to which the latch assembly 16 is secured in a manner detailed hereinafter. Each plate 32 extends between the sleeves 24 at the ends of the frame along opposite sides thereof.

U-bars 14 each comprise a pair of tubular legs 34 connected one to the other by a crossover bar 35. Each of the legs 34 includes a series of ratchet teeth 36 spaced one from the other therealong with the flat sides of the ratchet facing upwardly in a first direction and the angled sides facing laterally. Legs 34 are removable from and telescopically receivable in sleeves 24 along each of the opposite sides of lifting apparatus 10.

Additionally, casters 18 are mounted on stub tubes which are telescopically receivable in the lower ends of sleeves 24. While the casters 18 and their tubes 38 may comprise individual parts, preferably the casters along each side of apparatus 10 are connected one to the other by a longitudinally extending frame member 40 so that casters 18 can be inserted or coupled with the frame as a unit along each of its opposite sides. Thus, frame member 40 interconnects a pair of casters 18 along one side of apparatus 10 while another frame member 40 interconnects a pair of casters 18 along the opposite side of the apparatus forming two sets of unconnected casters.

Mounted along each side of frame 12 is a lifting tube 40. Tube 40 is secured, preferably by welding, to and along the underside of the structural member 22 along each side of the frame. Importantly each tube 40 is outwardly and upwardly inclined to the horizontal, for reasons which will be apparent from the ensuing description.

One or both of tubes 40 may have generally vertically oriented apertures adjacent their outer ends to receive a pin 42 for connecting a lever 44 to frame 12. More particularly, lever 44, as illustrated in FIG. 6, has a frustoconical end 46 having a pin opening 48 and which end 46 is pivotally secured to the main portion of lever 44, by a pin 50. By inserting portion 46 into a lifting tube 40 and inserting pin 42 through the registering openings of the tube and portion 46, lever 44 may be used as a handle for translating the lifting apparatus on casters 18 in a horizontal direction. The handle portion 46 and pin 50, however, are sized such that lever 44 may be inserted further into lifting tube 40, at which time the handle becomes a lifting lever as described hereinafter.

Figure 4:
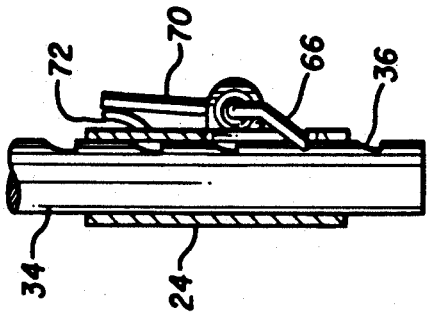
FIG. 4 is a fragmentary cross-sectional view illustrating the latching action between the frame and U-bars and taken generally about on line 4—4 in FIG. 1.
Figure 5:
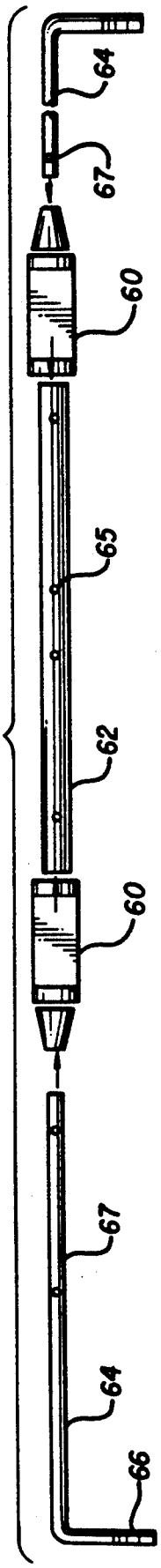
FIG. 5 is an exploded side elevational view with parts broken out for ease of illustration of a latching assembly for the lifting apparatus hereof.

Referring now to FIGS. 1 and 3-5, latching assembly 16 includes pairs of lugs 60 which project outwardly from plate 32 and which lugs 60 serve as bearings for rotatable latching assembly 16. As illustrated in FIG. 5, latching assembly 16 includes an outer tube 62 which receives horizontal portions of a pair of ratchet tongues 64 through its opposite ends. Tube 62 and tongues 64 have aligned screw openings 65 and 67 so that tube 62 and tongue 64 may become unitary in assembly upon insertion of screws 69 (FIG. 1) into the aligned openings. Tongues 64 are rotatably mounted in the bearings afforded by lugs 60. Each tongue 64 includes a bent portion carrying a ratchet catch 66 for engagement, through openings in sleeves 24, with the ratchet teeth 36 of the U-bar legs 34.

Figure 3:
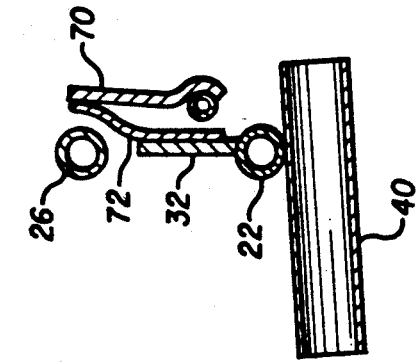
FIG. 3 is a cross-sectional view thereof taken generally about on line 3—3 in FIG. 1.

Referring to FIG. 3 and 4, there is illustrated a ratchet release finger 70 fixed to the tube 62. Underlying finger 70 and connected to the plate 32 is a leaf spring 72 which, as illustrated in FIG. 3, biases the ratchet assembly for rotation in a clockwise direction. That is, the ratchet assembly is biased by leaf spring 72 in a direction engaging the ratchet catches 66 in the ratchet teeth, as illustrated in FIG. 4. By pushing locking finger 70 against the bias of spring 72, the ratchet assembly is rotated in the opposite direction, releasing the ratchet catch from the ratchet teeth.

It will be appreciated from the foregoing description, that when the U-bars are telescopically received within the sleeves 24, the frame may be moved in the upward direction relative to the U-bars, i.e., a first direction, with the ratchet catches passing over the ratchet teeth against the bias of spring 72. The frame, however, is locked against movement in a downward or second direction by the engagement of the ratchet catches with the ratchet teeth. Further, the latches 16 on opposite sides of the lifting device are independently operable.

In operation, the lifting device is initially provided with the frame, U-bars and casters detached from one another. Thus, the frame may be placed directly on the floor, or with casters as necessary, adjacent an individual desiring to use the lifting apparatus (see FIG. 7A). Once the individual has positioned himself or herself on the seat 28, and assuming there is ample adjacent space for another individual to elevate the lifting device, the individual locates the lever 44 in one of the lifting tubes. Additionally, the U-bars are inserted into the sleeves 24 along opposite sides of the frame. The individual then lifts by means of lever 44 one side of the lifting device, pivoting it on the bottom of the sleeves 24 adjacent the opposite side of the lifting device. By lifting one side, the U-bar on that side is permitted to ratchet past the latching assembly 16, i.e., move downwardly relative to the frame, and, hence, project from the lower side of the sleeve 24, as illustrated in FIG. 7B. The leaf spring, of course, automatically biases the latching assembly into its latched condition, preventing, when lever 44 is removed from tube 40, the frame from sliding down along the U-bar. The lever 44 is then inserted into the opposite lifting tube 40, as illustrated in FIG. 7C. By lifting that side of the lifting device, pivoting it about the distal ends of the U-bar of the opposite side, the U-bar on the lifted side of the lifting device ratchets downwardly past the latching device. By alternately lifting the opposite sides of the lifting device, the frame is ratcheted upwardly in a first direction relative to the U-bars until it obtains a position wherein the platform or seat 28 of the frame is at an elevation corresponding to the chair or bed or a desired elevation (see FIG. 7E). That is, by alternately rocking the lifting device from side to side, the frame may be ratcheted upwardly along the U-bars.

It will, of course, be appreciated that the U-bars can be withdrawn from the frame after the individual has been removed from the seat. To accomplish this, the latching release finger is depressed against the bias of the spring, pivoting the ratchet catches outwardly away from engagement with the teeth. In this manner, the U-bars are free for sliding withdrawing movement relative to the sleeves 24 whereby the U-bars can be disconnected from the frame.

In those situations where the individual cannot be lifted at the particular site and where it is necessary to transport the individual to a more convenient site, the caster assembly 18 is provided on the bottom of the frame. With the frame located adjacent the individual, the individual may then be supported by the platform 28. The handle 44 is then inserted into the lifting tube and the pin 42 is inserted into the registering holes to secure the handle to the lifting device. With the individual on platform 28, the device may be pulled to a more convenient location. The handle is then disconnected and used as the lever to again pivot the lifting apparatus from side to side, as previously described. It will be appreciated that the initial lifting action on one side and the insertion of the legs of the U-bar into the sleeves of that side, will cause the casters to drop off that side. Similarly, when the opposite side is lifted, the casters will drop from the lifting device, leaving the device fully supported, for example, on a floor, by the distal ends of the U-bars.

Figure 8:
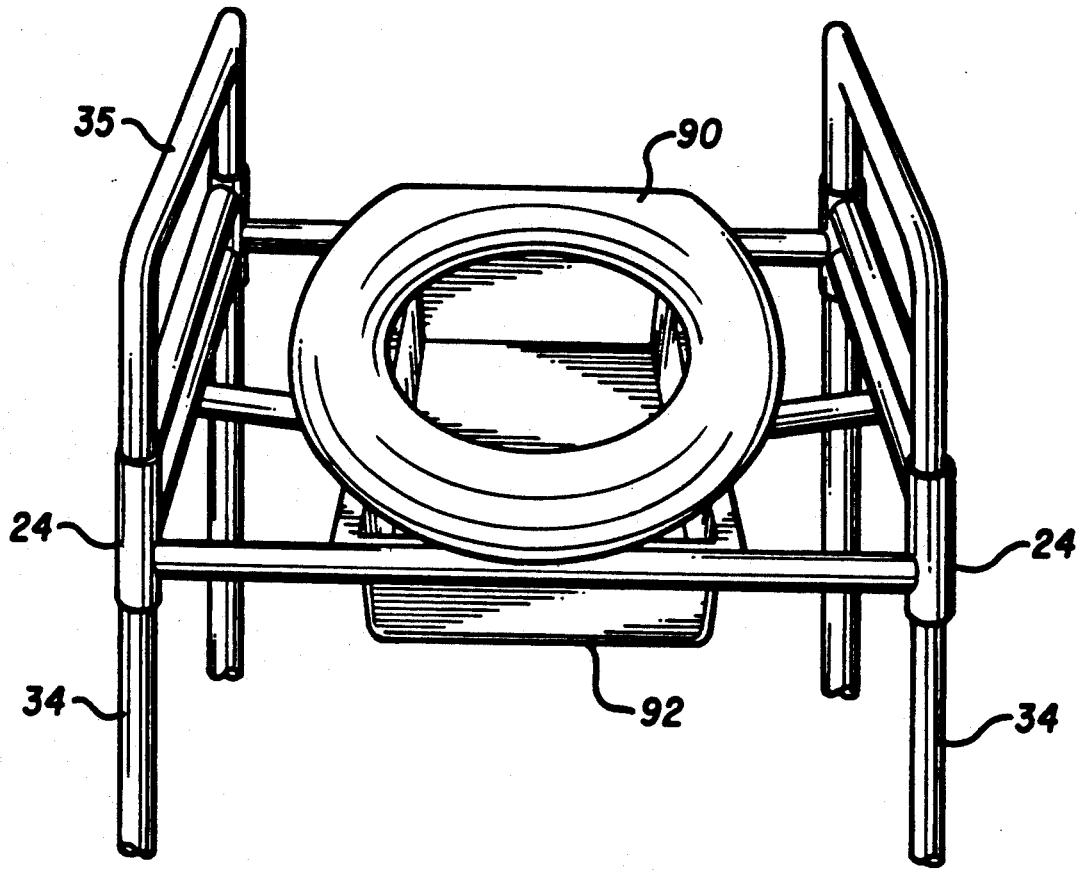
FIG. 8 is a fragmentary side elevational view of a further embodiment of the present invention.

In FIG. 8, there is disclosed an embodiment where the device may be transformed into a commode. To accomplish this, the seat 28 is removed or unclipped from the frame. A toilet seat 90 with a depending vessel 92 may be clipped to the frame in lieu of seat 28. Further, a load-bearing member, not shown, may be attached to the frame in lieu of the seat 28 whereby loads, such as heavy weights, may be lifted and transported.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for lifting a load, comprising:

a frame having a generally centrally disposed member for bearing a load and a plurality of elements spaced one from the other about the periphery of said frame, and first and second pairs of said elements lying on opposite sides of said frame;

first and second pairs of legs for disposition in slidable relation to said first and second pairs of elements, respectively;

cooperable means carried by said frame on said opposite sides thereof cooperable with said first and second pairs of legs, respectively, when said legs are disposed in slidable relation to said elements, for enabling movement of said frame relative to said legs in a first direction into selected adjusted positions relative to one another and for releasably precluding movement of said frame relative to said legs in a second direction opposite said first direction in each said selected adjusted position thereof;

said cooperable means on said opposite sides of said frame being independent of one another whereby one side of said frame is movable relative to the pair of legs on said one side thereof and in said first direction, while the other side of said frame and the other pair of legs on said other side of said frame remain immovable relative to one another; and alternate moving means carried by said frame for alternately moving said opposite sides of said frame in said first direction relative to the pair of legs on the corresponding side of said frame for displacing the load carried by said centrally disposed member in said first direction, wherein said first and second pairs of legs are in slidable telescopic relation relative to said first and second pairs of elements, respectively, said cooperable means including ratchet teeth spaced along said legs and ratchet catches carried by said frame and engageable with said ratchet teeth at said selected adjusted relative positions of said frame and said legs.

2. Apparatus according to claim 1 wherein said cooperable means includes means for biasing the ratchet catches into engagement with the ratchet teeth.

3. Apparatus according to claim 1 wherein said first and second pairs of elements comprise sleeves, said first and second pairs of legs comprise tubes telescopically receivable within said sleeves, said cooperable means including ratchet teeth spaced along said tubes and ratchet catches carried by said frame and engageable with said ratchet teeth in selected adjustable positions of said frame and said legs.

4. Apparatus according to claim 3 wherein said cooperable means includes an elongated assembly mounted on each of the opposite sides of said frame for rotational movement and terminating at opposite ends in a pair of said ratchet catches, respectively, and means for biasing each said assembly for rotation in a predetermined direction such that the ratchet catches carried thereby are urged into engagement with corresponding ratchet teeth.

5. Apparatus according to claim 4 wherein said elements have openings therethrough in registry with the ratchet teeth on the legs telescopically received in said elements, whereby said ratchet catches extend through said openings to engage said ratchet teeth.

6. Apparatus according to claim 1 wherein said first pair of legs are connected one to the other adjacent common end portions thereof to form a generally first inverted, generally U-shaped, bar, said second pair of legs being connected one to the other adjacent common end portions thereof to form a second inverted, generally U-shaped, bar.

7. Apparatus according to claim 1 wherein said means for alternately moving the opposite sides of said frame include means defining an opening and a handle receivable in said opening for lifting opposite sides of said frame.

8. Apparatus according to claim 1 wherein said first and second pairs of legs are detachable from said frame.

9. Apparatus according to claim 1 wherein said first pair of legs are connected one to the other adjacent common end portions thereof to form a first inverted, generally U-shaped, bar, said second pair of legs being connected one to the other adjacent common end portions thereof to form a second inverted, generally U-shaped, bar, said first and second U-shaped bars being detachable from said frame.

10. Apparatus according to claim 9 wherein said first and second pairs of legs are in slidable telescopic relation relative to said first and second pairs of elements, respectively, said cooperable means including ratchet teeth spaced along said legs and ratchet catches carried by said frame and engageable with said ratchet teeth at said selected adjusted relative positions of said frame and said legs, and casters receivable by said elements whereby said frame is mounted for rolling translational movement.

11. Apparatus according to claim 1 wherein said alternate moving means includes opening means defining an opening on each of the opposite sides of said frame, said opening being upwardly and outwardly inclined relative to said frame, and a handle receivable in said opening for lifting opposite sides of said frame.

12. A method for lifting a load, comprising the steps of:

(a) providing a frame having a generally centrally disposed member for bearing a load, a plurality of sleeves spaced one from the other about the periphery of said frame, and first and second pairs of said elements lying on opposite sides of said frame;

(b) disposing a first and second pairs of legs in slidable telescopic relation with said first and second pairs of sleeves, respectively, ratchet teeth are spaced along said legs and ratchet catches are carried by said frame and including the step of engaging said ratchet catches with said ratchet teeth at said selected adjusted relative positions of said frame and said legs;

(c) moving one side of said frame and said first sleeves of said frame upwardly relative to said first pair of legs into a first selected adjusted elevation while precluding movement of the opposite side of said frame and said second sleeves thereof relative to said second pair of legs in a downward direction;

(d) subsequently moving the opposite side of said frame and said second sleeves thereof upwardly relative to said second pair of legs into a second selected adjusted elevation above said first elevation while precluding movement of the one side of said frame and said first sleeves thereof relative to said first pair of legs in a downward direction; and (e) alternately moving opposite sides of said frame in accordance with steps (c) and (d) hereof for displacing the load carried by said centrally disposed member in an upward direction.

13. A method according to claim 12 including the step of biasing the ratchet catches into engagement with the ratchet teeth.

14. A method according to claim 12 including attaching a lever alternately to opposite sides of said frame for moving each side thereof in an upward direction.

15. A method according to claim 12 including applying a lifting lever alternately to opposite sides of said frame for lifting said opposite frame sides in succession.

* * * * *